US007559123B1

(12) United States Patent
Yang

(10) Patent No.: US 7,559,123 B1
(45) Date of Patent: Jul. 14, 2009

(54) SIDE RELEASE BUCKLE

(75) Inventor: Yao-Ming Yang, Taichung (TW)

(73) Assignee: Nifco Taiwan Corporation, Taipei (TW)

( * ) Notice: Subject to any disclaimer, the term of this patent is extended or adjusted under 35 U.S.C. 154(b) by 4 days.

(21) Appl. No.: 11/972,637

(22) Filed: Jan. 11, 2008

(51) Int. Cl.
*A44B 11/26* (2006.01)

(52) U.S. Cl. ..... 24/316; 24/625

(58) Field of Classification Search ..... 24/614–616, 24/625, 3.1, 316, 318, 319, 321, 322.1, 323, 24/324, 165, 199, 185, 187, 189, 192, 195, 24/573.09, 573.11, 578.14, 578.15, 579.09, 24/579.11, 581.1, 581.12, 582.1, 582.11, 24/265 H, 265 EC; 224/583, 197, 605, 617, 224/621, 268, 163

See application file for complete search history.

(56) References Cited

U.S. PATENT DOCUMENTS 6,695,269 B1 * 2/2004 Anscher ..... 248/225.11
2006/0016050 A1 * 1/2006 Yoshiguchi ..... 24/3.12

* cited by examiner

*Primary Examiner*—James R Brittain

(57) ABSTRACT

A side release buckle includes a female buckle member, which has two female coupling arms each having a forwardly extending coupling hole and a side opening, a male buckle member, which has two forwardly extending spring arms and two male coupling arms respectively forwardly extending from the spring arms and insertable with the spring arms into the coupling holes of the female coupling arms for engagement with the side openings of the female coupling arms, and an adapter member, which has a mounting base that is inserted into a receiving space between the female coupling arms of the female buckle member before connection of the male buckle member and locked thereto after connection of the male buckle member and a coupling device at the top side for fastening to an external object.

13 Claims, 11 Drawing Sheets

SIDE RELEASE BUCKLE

BACKGROUND OF THE INVENTION

1. Field of the Invention

The present invention relates to buckles and more particularly, to a side release buckle, which comprises an adapter member set between the female buckle member and the male buckle member thereof for securing an external object.

2. Description of the Related Art

Various different buckles are known for different purposes. Conventional buckles are commonly formed of a male buckle member and a female buckle member, and intensively used in shoes, clothes, backpacks, travel bags, shoulder bags, helmets, bicycle attachments, safety belts of baby trolleys, etc., to join belt members or to adjust the tension of a strap member. Different buckles have different engagement structures and provide different functions for different purposes.

Further, following the application of the system of two days off per week, sports recreation and leisure activities have become a hot trend. People may participate in bicycle riding, mounting climbing or fishing activities during the weekend. Further, a bicycle may be provided with a rack for carrying a container (water bottle, tool box or storage box). FIGS. 10 and 11 show two different container rack mounting structures. According to the design shown in FIG. 13, the container rack is a bottle rack made out of a metal wire rod and affixed to a bicycle frame with screws. According to the design shown in FIG. 14, the container rack is a bottle rack made out of a metal wire rod and fastened to a bicycle frame with a clamping assembly.

The aforesaid two bottle rack mounting designs have drawbacks as follows:

1. The installation of the aforesaid two bottle rack mounting designs requires a hand tool. According to the design shown in FIG. 13, a metal mounting plate is welded to the bottle rack for the mounting of screws to affix the bottle rack to a bicycle frame. The processing process and mounting procedure of the aforesaid two bottle rack mounting designs are complicated, resulting in a high mounting cost.

2. After installation, the two bottle rack mounting structures are not detachable from the respective bicycle frames when not in use, and the storage items may be stolen by an evil person. Further, the empty bottle rack mounting structure destructs the sense of beauty of the bicycle.

3. The holding size of each of the aforesaid two container rack mounting structures is not adjustable. The container (bottle) may fall from the rack if the size does not match.

SUMMARY OF THE INVENTION

The present invention has been accomplished under the circumstances in view. It is the main object of the present invention to provide a side release buckle, which has an adapter member provided between the male buckle member and the female buckle member for securing an external object. To achieve this and other objects of the present invention, the side release buckle is comprised of a male buckle member, a female buckle member and an adapter member. The female buckle member comprises two female coupling arms. Each female coupling arm has a forwardly extending coupling hole, and a side opening. The male buckle member comprises two forwardly extending spring arms, and two male coupling arms respectively forwardly extending from the spring arms and insertable with the spring arms into the coupling holes of the female coupling arms for engagement with the side openings of the female coupling arms. The adapter member comprises a mounting base that is inserted into a receiving space between the female coupling arms of the female buckle member before connection of the male buckle member and locked thereto after connection of the male buckle member, and a coupling device at the top side for fastening to an external object. The coupling device can be made in any of a variety of forms for securing different objects.

DETAILED DESCRIPTION OF THE PREFERRED EMBODIMENT

Figure 1:
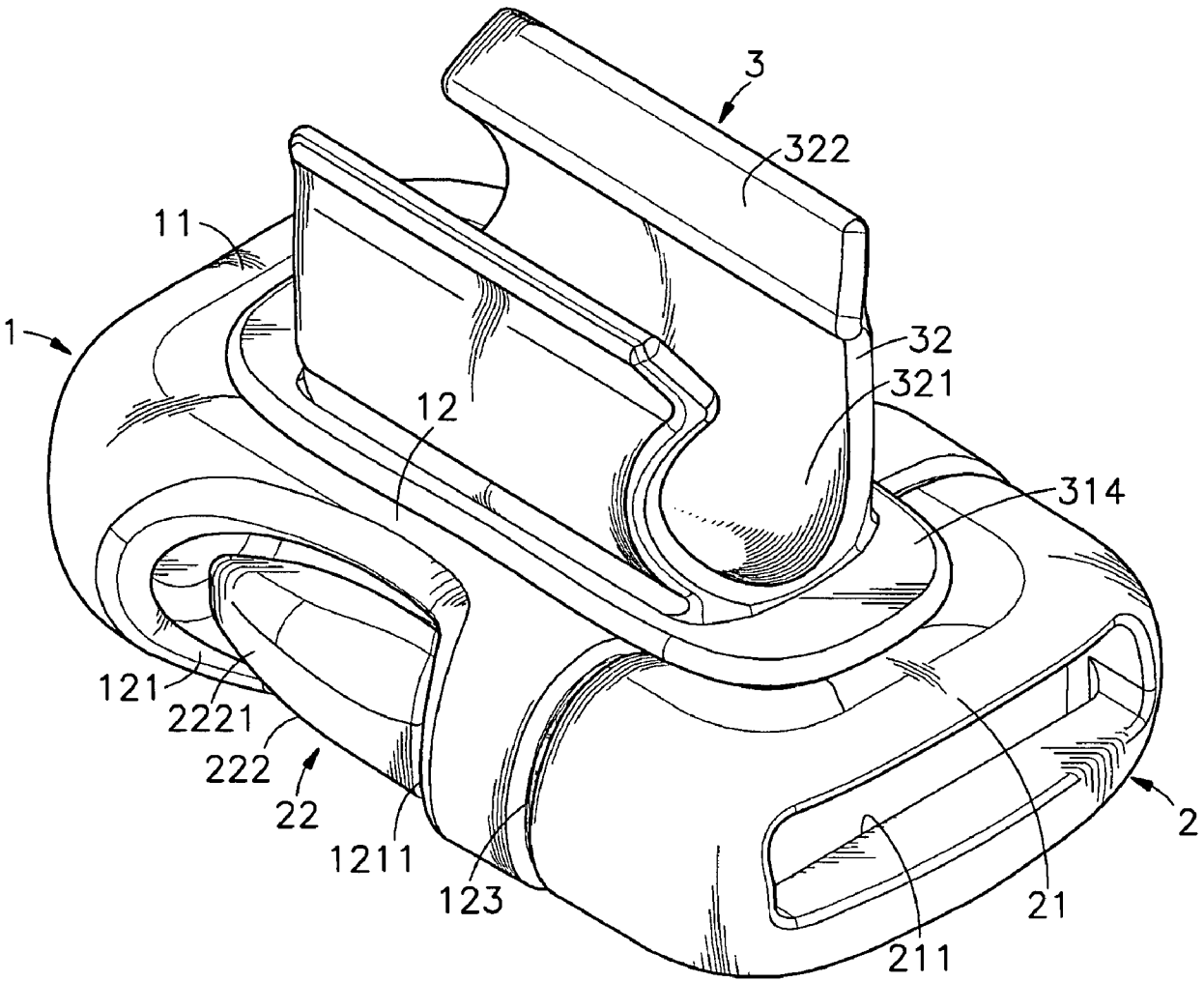
FIG. 1 is an elevational assembly view of a side release buckle in accordance with a first embodiment of the present invention.
Figure 2:
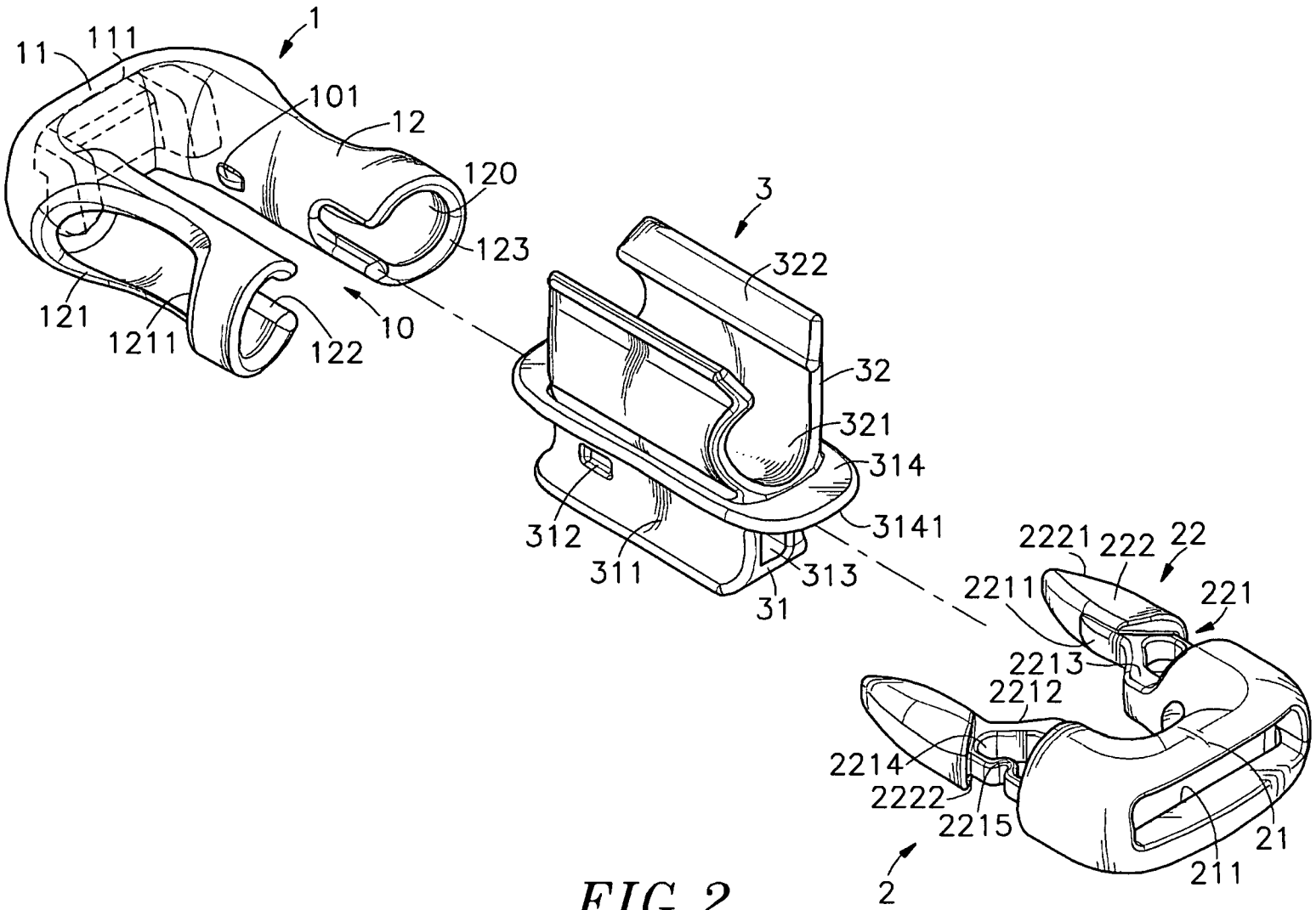
FIG. 2 is an exploded view of the side release buckle shown in FIG. 1.
Figure 3:
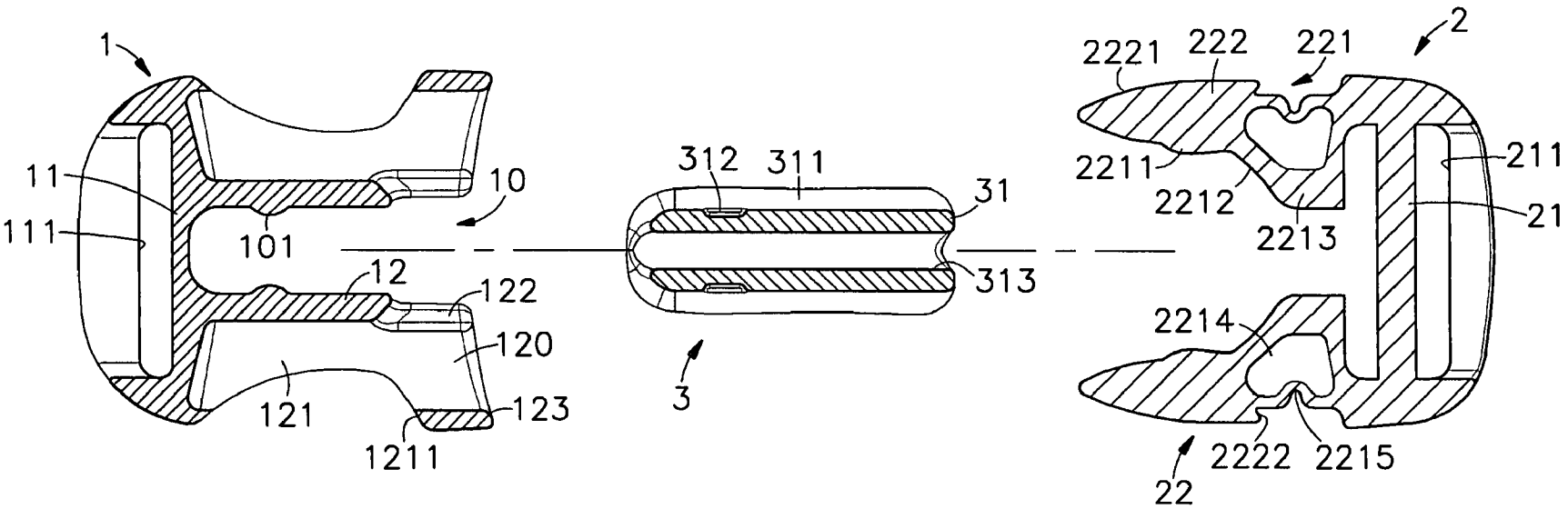
FIG. 3 is a top view in section of FIG. 2.

Referring to FIGS. 1~3, a side release buckle in accordance with a first embodiment of the present invention is shown comprising a female buckle member 1, a male buckle member 2 and adapter member 3 provided between the female buckle member 1 and the male buckle member 2.

The female buckle member 1 comprises a transversely extending base 11, an mounting slot 111 cut through the base 11 for the mounting of a belt member, two female coupling arms 12 respectively perpendicularly extending from the two distal ends of the base 11 in a parallel manner and defining with the base 11 a forwardly extending receiving space 10, and two retaining blocks 101 respectively protruded from the periphery of the female coupling arms 12 and suspending in the receiving space 10. The female coupling arms 12 each have a front open end 123, a coupling hole 120 axially extending to the front open end 123, a side opening 121 at an outer side, a stop edge 1211 at the front side of the side opening 121, and a sliding groove 122 axially extending to the front open end 123 at an inner side in communication between the coupling hole 120 and the receiving space 10.

The male buckle member 2 comprises a transversely extending base 21, a mounting slot 211 cut through the base 21 for the mounting of a belt member, and a coupling structure 22 for fastening the base 21 to the female buckle member 1. The coupling structure 22 comprises two spring arms 221 perpendicularly extending from the two distal ends of the base 21 in a parallel manner, and two male coupling arms 222 respectively forwardly extending from the free ends of the spring arms 221 corresponding to the female coupling arms 12 of the female buckle member 1. The spring arms 221 each have a sliding rail 2211 longitudinally disposed at an inner side and defining a beveled guide face 2212, a positioning portion 2213 at a rear side of the beveled guide face 2212, a Ω-shaped buffer arm portion 2215 connected between the associating male coupling arm 222 and the base 21 at an outer side in a substantially parallel manner relative to the sliding rail 2211, and a buffer space 2214 defined between the beveled guide face 2212 and the Ω-shaped buffer arm portion 2215. The male coupling arms 222 each have an outer sloping face 2221 extending outwardly backwards toward the Ω-shaped buffer arm portion 2215 of the associating spring arm 221, and a stop edge 2222 connected between the outer sloping face 2221 and the Ω-shaped buffer arm portion 2215 of the associating spring arm 221.

The adapter member 3 comprises a mounting base 31 and a coupling device 32 fixedly provided at the top side of the mounting base 31. The mounting base 31 has a center through hole 313 longitudinally extending through its two distal ends, two coupling grooves 311 extending along its length at two opposite lateral sides relative to the center through hole 313 and fitting the periphery of the female coupling arms 12 of the female buckle member 1, two retaining holes 312 respectively formed in the coupling grooves 311 for receiving the retaining blocks 101 of the female buckle member 1, and a top flange 314 horizontally extending around the border in flush with its top surface. The top flange 314 has a beveled bottom surface portion 3141 reducing gradually outwards. The coupling device 32 is a substantially U-shaped resilient plate member formed integral with the top wall of the mounting base 31, having a coupling groove 321 extending along its length and two beveled guide faces 322 bilaterally disposed above the coupling groove 321. The gap defined between the beveled guide faces 322 is narrower than the transverse width of the coupling groove 321.

Figure 4:
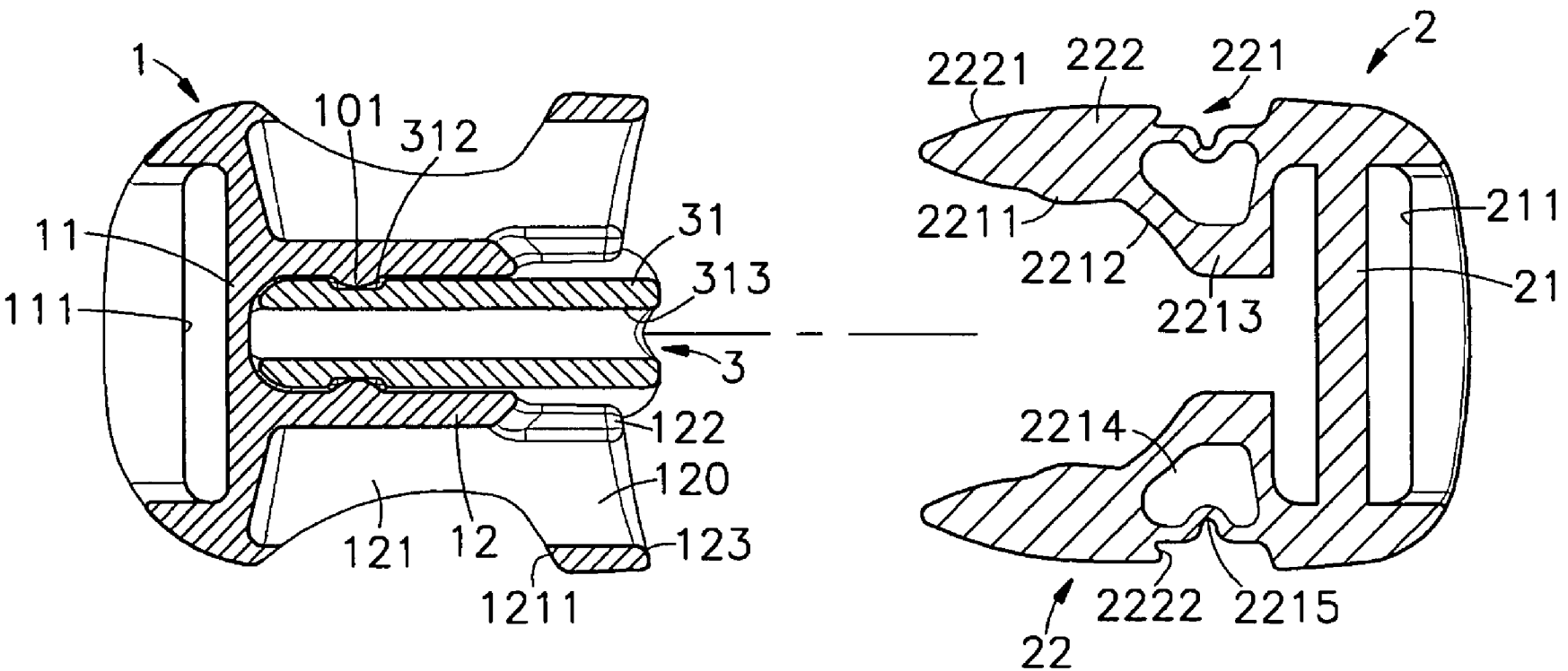
FIG. 4 corresponds to FIG. 3, showing the adapter member set in the female buckle member.
Figure 5:
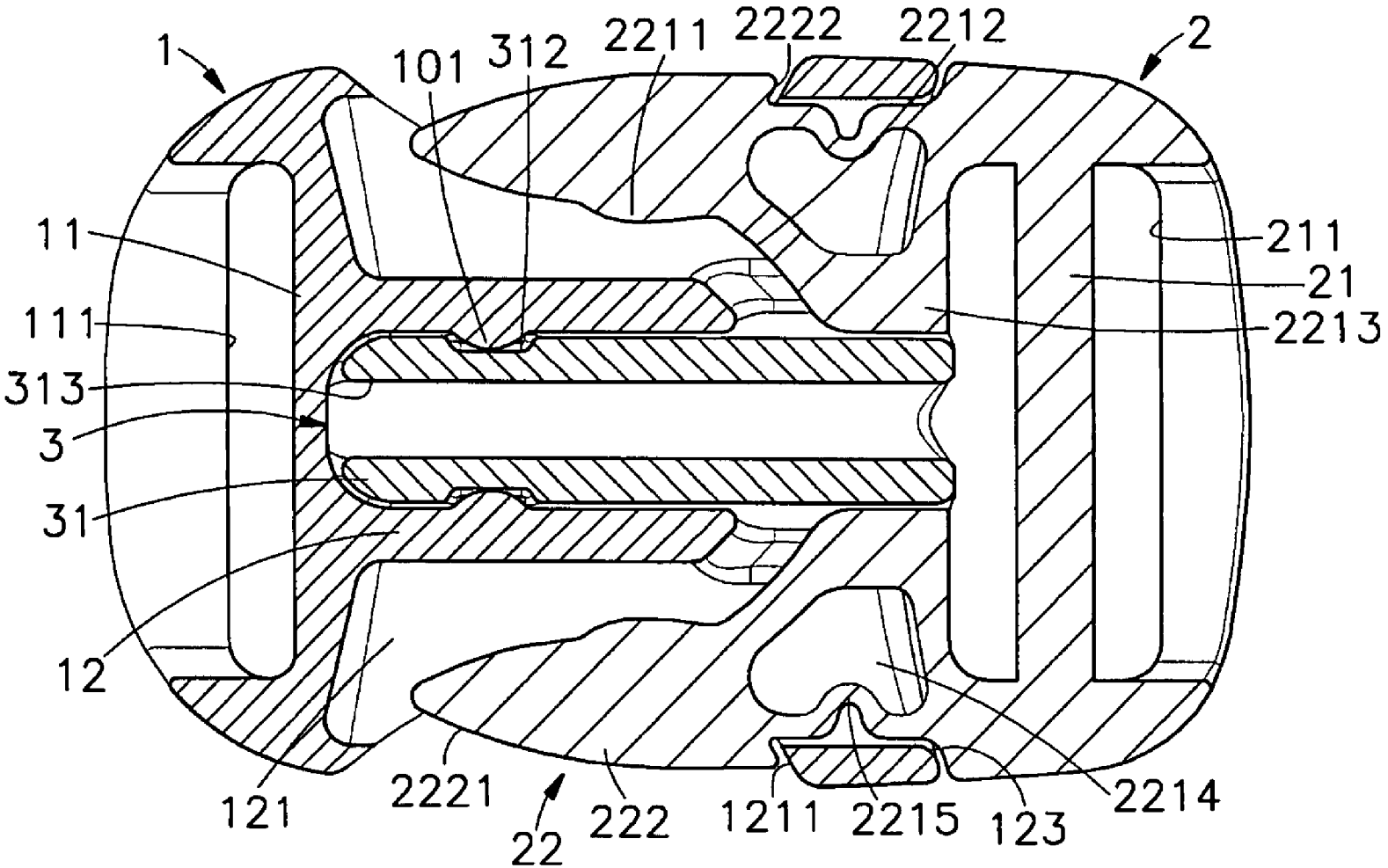
FIG. 5 is a top view in section of FIG. 1.

Referring to FIGS. 4 and 5 and FIGS. 2 and 3 again, during installation, the mounting base 31 of the adapter member 3 is inserted into the receiving space 10 in between the two female coupling arms 12 of the female buckle member 1 to have the two female coupling arms 12 be respectively received to the coupling grooves 311 of the base 31 and to force the retaining holes 312 of the base 31 into engagement with the retaining blocks 101 of the female buckle member 1. Thereafter, the male coupling arms 222 of the coupling structure 22 of the male buckle member 2 are respectively inserted into the front open ends 123 and the coupling holes 120 of the female coupling arms 12 of the female buckle member 1. When inserting the male coupling arms 222 into the coupling holes 120, the outer sloping surface 2221 of the male coupling arms 222 are moved over the respective front open ends 123 of the female coupling arms 2, causing the male coupling arms 222 to forced inwards toward each other. When continuously forcing the male buckle member 2 forwards toward the inside of the female buckle member 1, the sliding rails 2211 are respectively moved into the sliding grooves 122 of the female coupling arms 12 to the position where the stop edges 2222 of the male coupling arms 222 are respectively forced into the side openings 121 of the female coupling arms 12 and stopped at the stop edges 1211 of the female coupling arms 12 to prohibit backward displacement of the male buckle member 2 relative to the female buckle member 1. At this time, the adapter member 3 is firmly secured in between the female buckle member 1 and the male buckle member 2.

Referring to FIGS. 4 and 5 again, during forward movement of the two spring arms 221 of the male buckle member 2 relative to the female buckle member 1, the beveled guide face 2212 and the positioning portion 2213 of the spring arms 221 are also forced inwards toward the center of the male buckle member 2, and the buffer arm portions 2215 and the buffer spaces 2214 allow deformation of the spring arms 221 without damage.

Referring to FIGS. 1 and 2 again, the top flange 314 is stopped at the top side of the female buckle member 1 and the male buckle member 2, keeping the receiving space 10 from sight and causing a sense of beauty.

Figure 6:
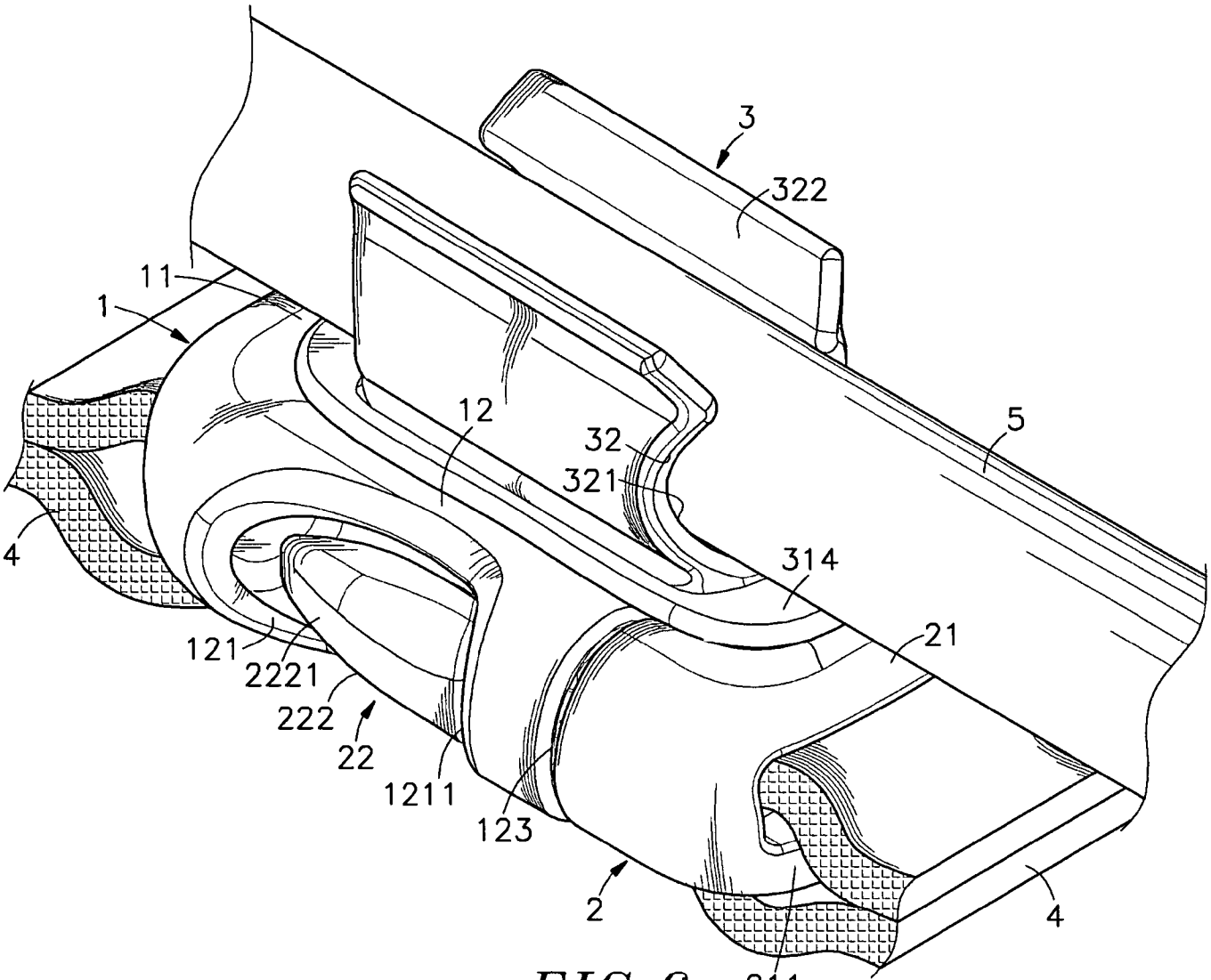
FIG. 6 is an applied view of the side release buckle in accordance with the first embodiment of the present invention.

Referring to FIG. 6 and FIGS. 1 and 2 again, by means of the mounting slots 111 and 211, the female buckle member 1 and the male buckle member 2 are respectively fastened to two belt members 4 of an article (not shown). Because the mounting slots 111 and 211 are formed in the bases 11 and 21 at a lower side, the belt member 4 is not extending over the top side of the bases 11 and 21. Therefore, when the side release buckle of the present invention is installed, it causes a sense of beauty. Further, the coupling device 32 is a substantially U-shaped resilient plate member formed integral with the top wall of the mounting base 31. An object 5 (a rod member) can be forced through the gap between the beveled guide faces 322 into the coupling groove 321. When forcing the periphery of the object 5 (the rod member) downwardly against the two beveled guide faces 322, the two beveled guide faces 322 are forced outwards to expand the gap therebetween, and therefore the object 5 (the rod member) can easily be positioned in the coupling groove 321.

Figure 7:
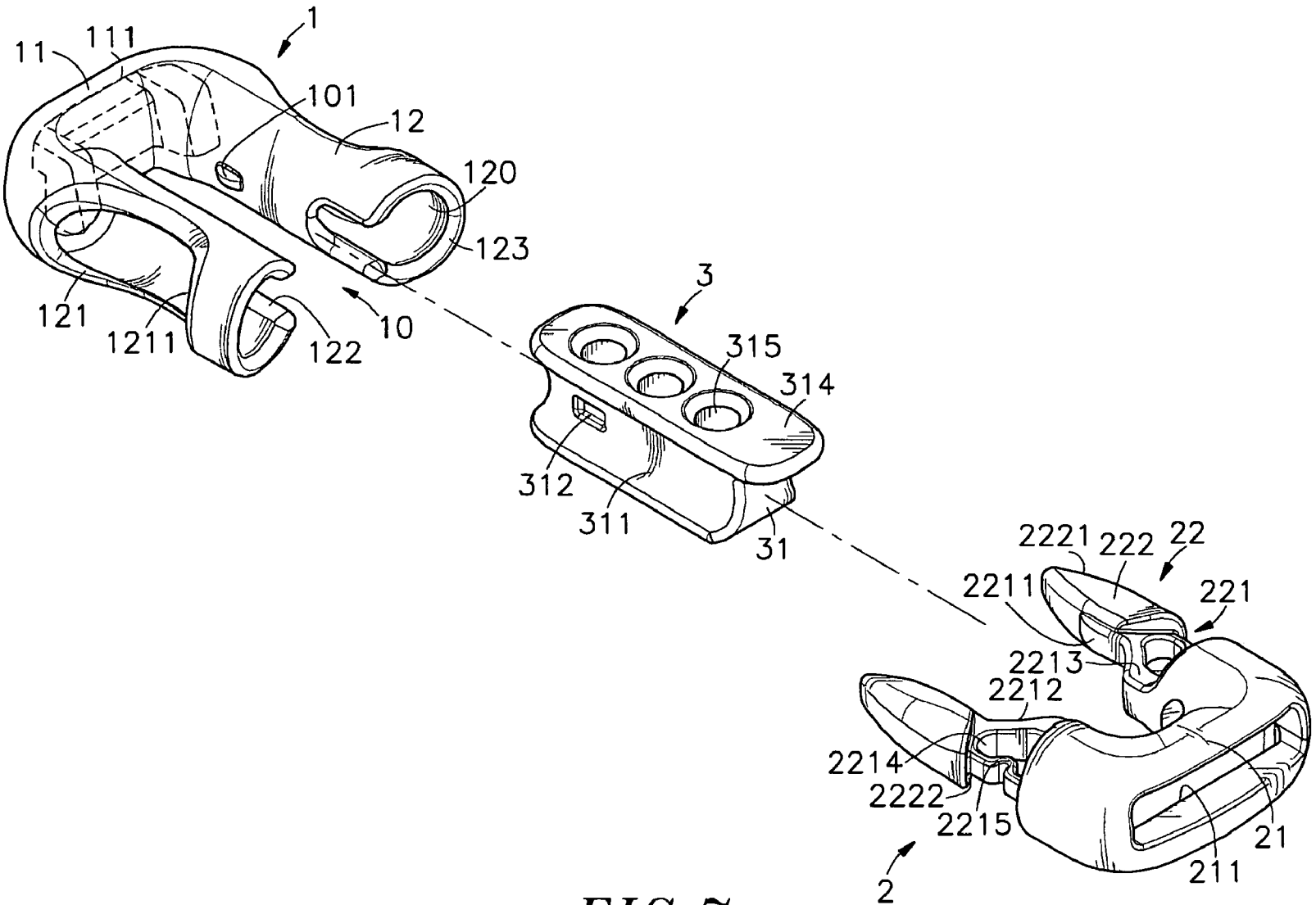
FIG. 7 is an exploded view of a side release buckle in accordance with a second embodiment of the present invention.

FIG. 7 is an exploded view of a side release buckle in accordance with a second embodiment of the present invention. This embodiment is substantially similar to the aforesaid first embodiment with the exception that the adapter member 3. According to this embodiment, the adapter member 3 eliminates the aforesaid coupling device 32, and has a plurality of mounting through holes 315 on the top wall of the mounting base 31.

Figure 8:
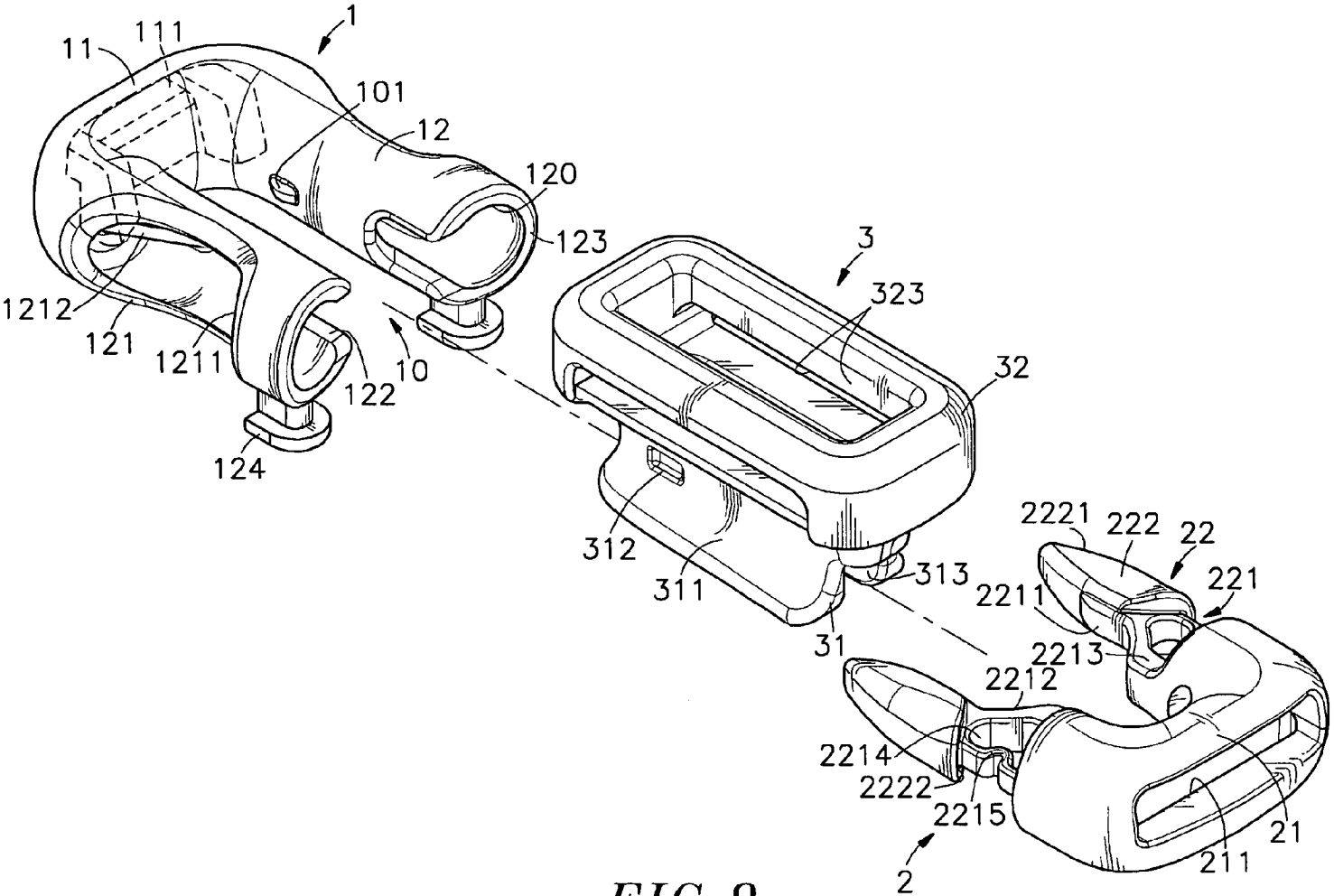
FIG. 8 is an exploded view of a side release buckle in accordance with a third embodiment of the present invention.

FIG. 8 is an exploded view of a side release buckle in accordance with a third embodiment of the present invention. This embodiment is substantially similar to the aforesaid first embodiment with the exception that the adapter member 3. According to this embodiment, the coupling device 32 of the adapter member 3 comprises at least one mounting slot 323 for the mounting of a belt member or multiple belt members.

Figure 9:
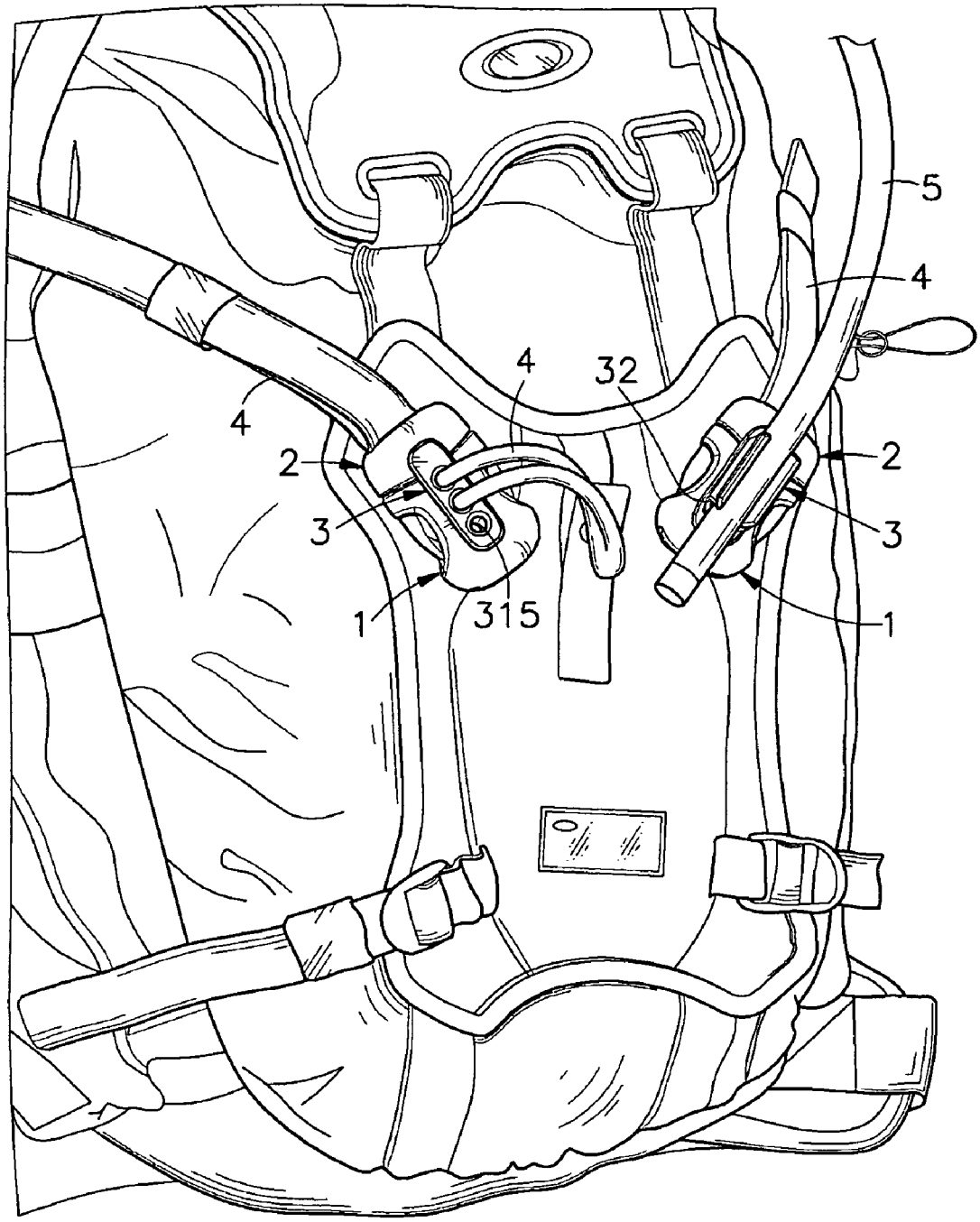
FIG. 9 is an applied view of the present invention.
Figure 10:
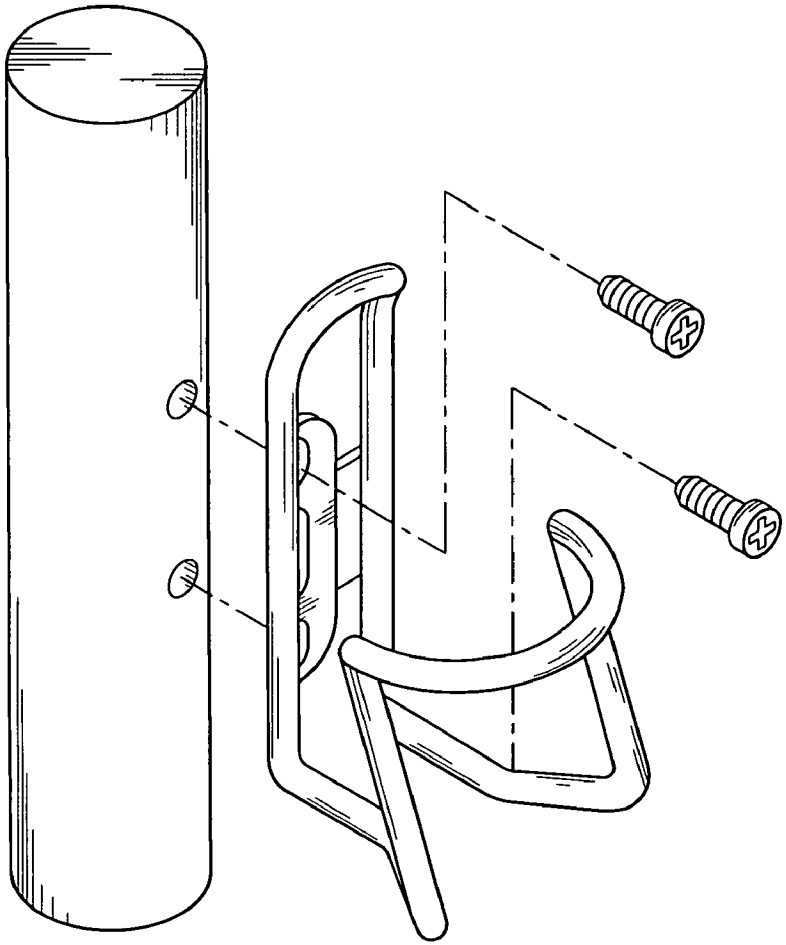
PRIOR ART FIG. 10
FIG. 10 is an exploded view, showing a container rack mounting structure according to the prior art.
Figure 11:
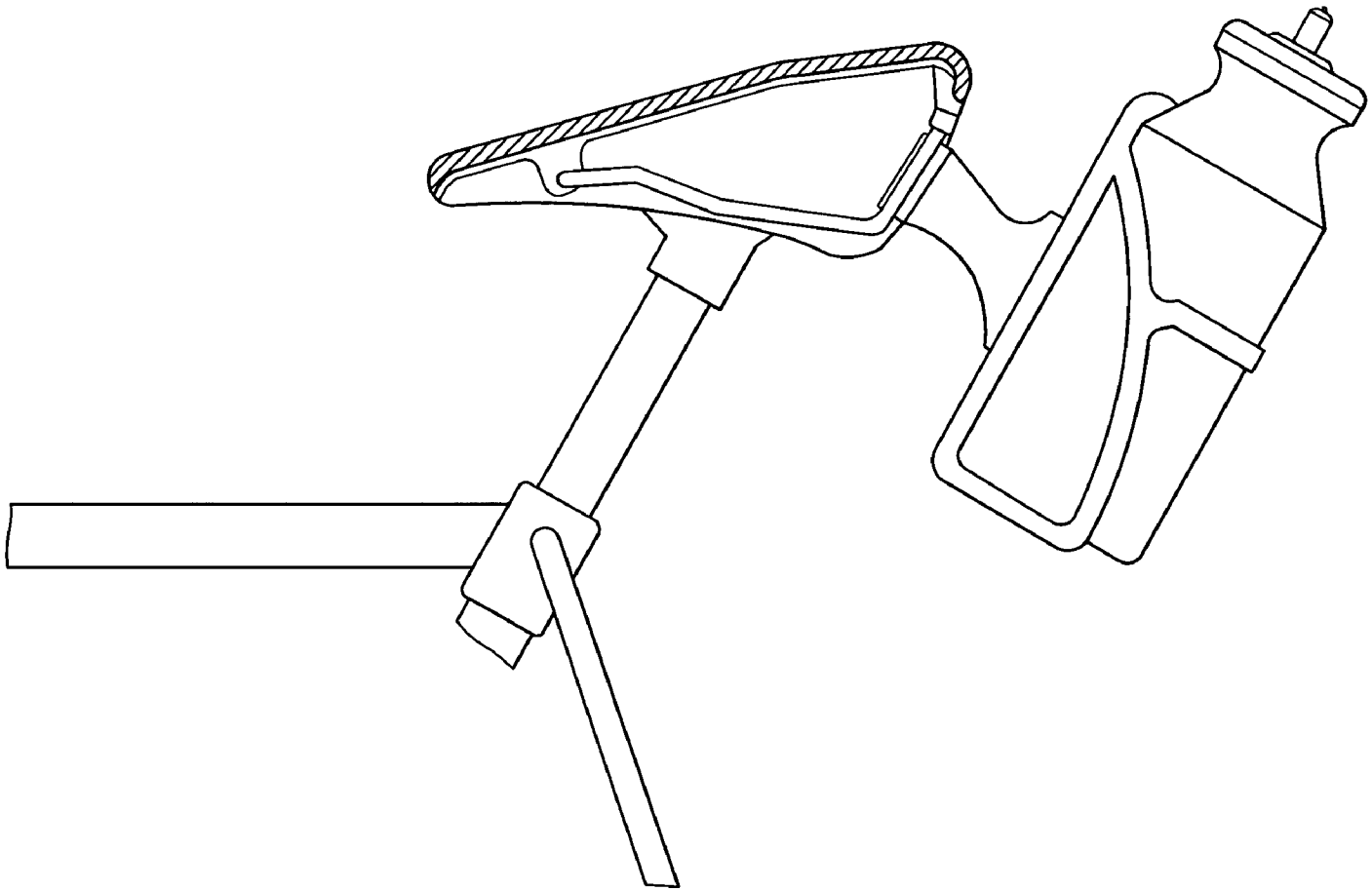
PRIOR ART FIG. 11
FIG. 11 is a schematic drawing showing another design of container rack mounting structure according to the prior art.

Referring to FIG. 9 and FIGS. 1 and 2, the female buckle members 1 and the male buckle members 2 of two side release buckles are respectively fastened to belt members 4 of a backpack for closing the cover flap of the backpack, the coupling device 32 of one side release buckle is used to hold an object 5 (a suction tube) of a water bottle, and the coupling device 32 of the other side release buckle has mounting through holes 315 for the mounting of belt members 4 to secure a hand lamp or bunch of keys.

By means of the adapter member 3, the male buckle member 1 and the female buckle member 2 are easily detachably connectable to a belt or loop-like member of an article.

As stated above, the invention provides a side release buckle, which comprises a male buckle member, a female buckle member and an adapter member set in between the male buckle member and the female buckle member. When installation of the male buckle member and the female buckle member, the adapter member is firmly secured to the male buckle member and the female buckle member to hold an external device.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A side release buckle comprising:

a female buckle member, said female buckle member comprising a transversely extending base, a mounting hole cut through said transversely extending base of said female buckle member for the mounting of a belt member, and two female coupling arms respectively extending from two distal ends of said transversely extending base of said female buckle in a parallel manner and defining therebetween a receiving space, said female coupling arms each having a coupling hole forwardly extending to a front open end thereof and a side opening at an outer side;

a male buckle member, said male buckle member comprising a transversely extending base, two spring arms respectively extending from two distal ends of said transversely extending base of said male buckle in a parallel manner, and two male coupling arms respectively forwardly extending from said spring arms and insertable with said spring arms into said coupling holes of said female coupling arms of said female buckle member for engagement with said side openings of said female coupling arms of said female buckle member; and an adapter member insertable into said receiving space between said female coupling arms of said female buckle member and lockable to said female buckle member by said male buckle member for securing an external object, said adapter member comprising two coupling grooves longitudinally symmetrically disposed at two opposite lateral sides of a mounting base thereof and respectively coupled to said female coupling arms of said female buckle member when said adapter member is inserted into said receiving space between said female coupling arms of said female buckle member.

2. The side release buckle as claimed in claim 1, wherein said adapter member comprises two retaining holes respectively disposed in said coupling grooves of said adapter member; said female coupling arms of said female buckle member each have a retaining block for engaging said retaining holes of said adapter member.

3. The side release buckle as claimed in claim 1, wherein said female coupling arms of said female buckle member each have a stop edge at a front side of said respective side opening; said male buckle member comprises two stop edges respectively connected between said male coupling arms and said spring arms for engagement with said stop edges of said female coupling arms of said female buckle member.

4. The side release buckle as claimed in claim 1, wherein said female coupling arms of said female buckle member each comprise a sliding groove axially extending to said respective front open end at an inner side for guiding said male coupling arms and said spring arms of said male buckle member into said female coupling arms of said female buckle member.

5. The side release buckle as claimed in claim 4, wherein said spring arms of said male buckle member each comprise a sliding rail longitudinally disposed at an inner side corresponding to said sliding grooves of said female coupling arms of said female buckle member and defining a beveled guide face, and a positioning portion disposed at a rear side of said beveled guide face at said sliding rail.

6. The side release buckle as claimed in claim 5, wherein said spring arms of said male buckle member each further comprise a buffer arm portion connected between said associating male coupling arm and said transversely extending base of said male buckle member at an outer side in a substantially parallel manner relative to said sliding rail thereof, and a buffer space defined between said beveled guide face thereof and said buffer arm portion.

7. The side release buckle as claimed in claim 1, wherein the male coupling arms of said male buckle member each have an outer sloping face.

8. The side release buckle as claimed in claim 1, wherein adapter member comprises a top flange horizontally extending around the border of said mounting base of said adapter member in flush with a top surface of said mounting base of said adapter member.

9. The side release buckle as claimed in claim 8, wherein said top flange of said adapter member has a beveled bottom surface portion reducing gradually outwards.

10. The side release buckle as claimed in claim 1, wherein said adapter member comprises a plurality of vertically extending mounting through holes on a top side of the mounting base thereof.

11. The side release buckle as claimed in claim 1, wherein said adapter member comprises a coupling device disposed at a top side of the mounting base thereof for connection to an external object.

12. The side release buckle as claimed in claim 11, wherein said coupling device of said adapter member is a U-shaped plate member fixedly connected to the mounting base of said adapter member, said U-shaped plate member having a coupling groove extending along the length thereof, and two beveled guide faces bilaterally disposed above said coupling groove of said U-shaped plate member, said two beveled guide faces of said U-shaped plate member defining therebetween a gap that is narrower than the transverse width of said coupling groove of said adapter member.

13. The side release buckle as claimed in claim 11, wherein said coupling device of said adapter member comprises at least one mounting slot for the fastening of a belt member.

* * * * *